United States Patent [19]

Knight

[11] 4,406,148

[45] Sep. 27, 1983

[54] MULTI-STATION TRANSFER PRESS HAVING TRANSFER SLIDE SAFETY RELEASE MEANS

[75] Inventor: David W. Knight, Stratford, Conn.

[73] Assignee: The U.S. Baird Corporation, Stratford, Conn.

[21] Appl. No.: 246,729

[22] Filed: Mar. 23, 1981

[51] Int. Cl.[3] ..... B21D 43/05

[52] U.S. Cl. ..... 72/405; 72/421

[58] Field of Search ..... 72/405, 404, 421, 422; 414/750; 198/719; 74/55, 527

[56] References Cited

U.S. PATENT DOCUMENTS

| | | | |
|---|---|---|---|
| 2,049,915 | 8/1936 | Lewis . | |
| 2,644,428 | 7/1953 | Ford | 74/527 |
| 2,791,914 | 5/1957 | Cornelius | 74/527 |
| 2,835,152 | 5/1958 | Lamprecht . | |
| 3,738,503 | 6/1973 | Wallis | 198/719 |
| 3,862,564 | 1/1975 | Blase . | |
| 3,985,213 | 10/1976 | Braggins . | |
| 4,003,237 | 1/1977 | O'Keefe . | |
| 4,032,018 | 6/1977 | Wallis | 414/750 |
| 4,102,174 | 7/1978 | Blase | 72/421 |
| 4,166,372 | 9/1979 | Knight . | |
| 4,198,845 | 4/1980 | Sofy | 72/421 |

*Primary Examiner*—Gene Crosby

*Attorney, Agent, or Firm*—Cifelli, Frederick & Tully

[57] ABSTRACT

A multi-station strip metal forming press has a safety release mechanism for the transfer slide to protect the press components in the event of a jam or internal breakage. A press frame has a plurality of horizontally spaced work stations and supports a vertically reciprocable ram; a plurality of tools carried by and movable with the ram, positioned to be operatively disposed at the stations and cooperate with dies thereat to perform work on workpieces positioned at the work stations. A horizontally movable transfer slide and associated transfer rails are provided for carrying workpieces sequentially in a predetermined manner to the stations. A powered mechanism reciprocates said transfer slide and ram in timed relationship. A safety release mechanism for the transfer slide operatively disconnects the powered mechanism from said transfer slide on the occurrence of a jam anywhere in the press regardless of the point in the cycle of press operation or position of the jam and causes the transfer slide to stop.

18 Claims, 9 Drawing Figures

Fig. 1.
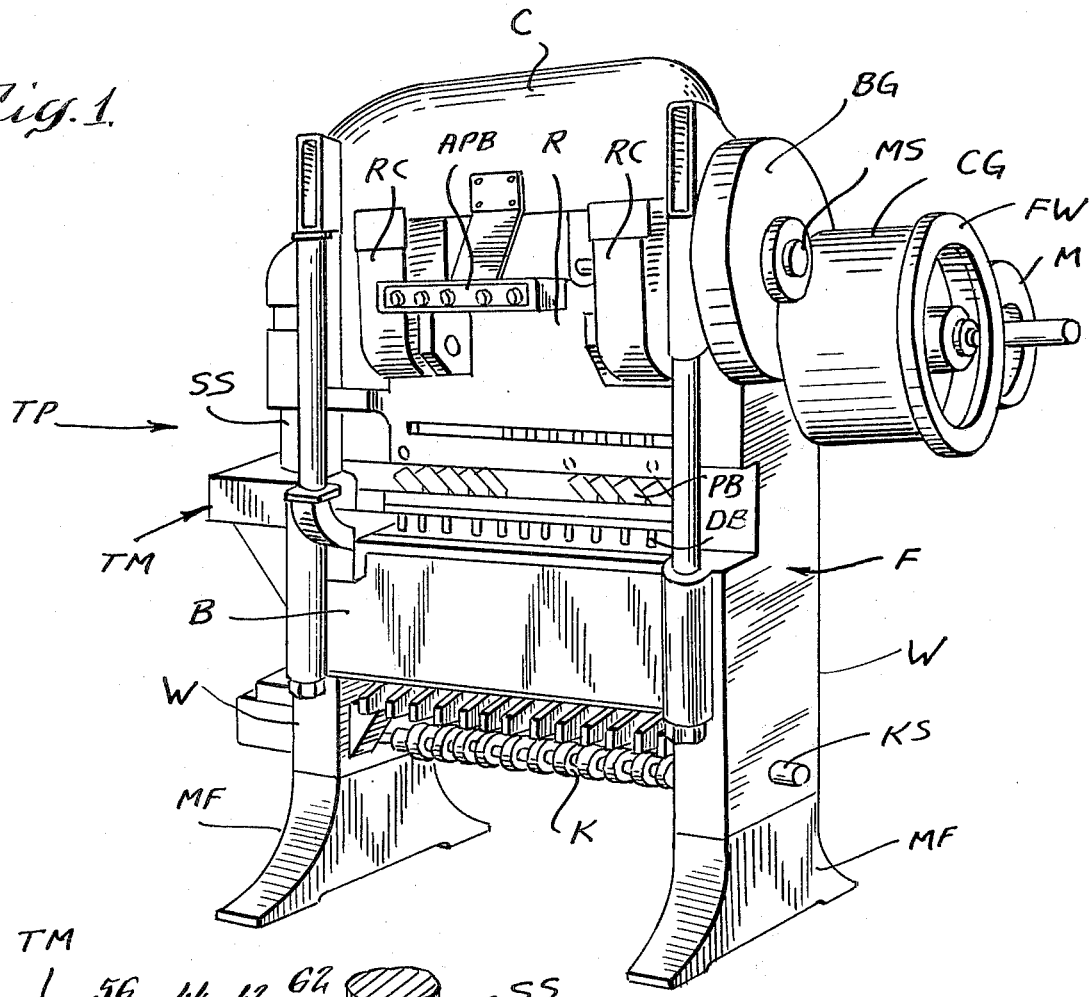
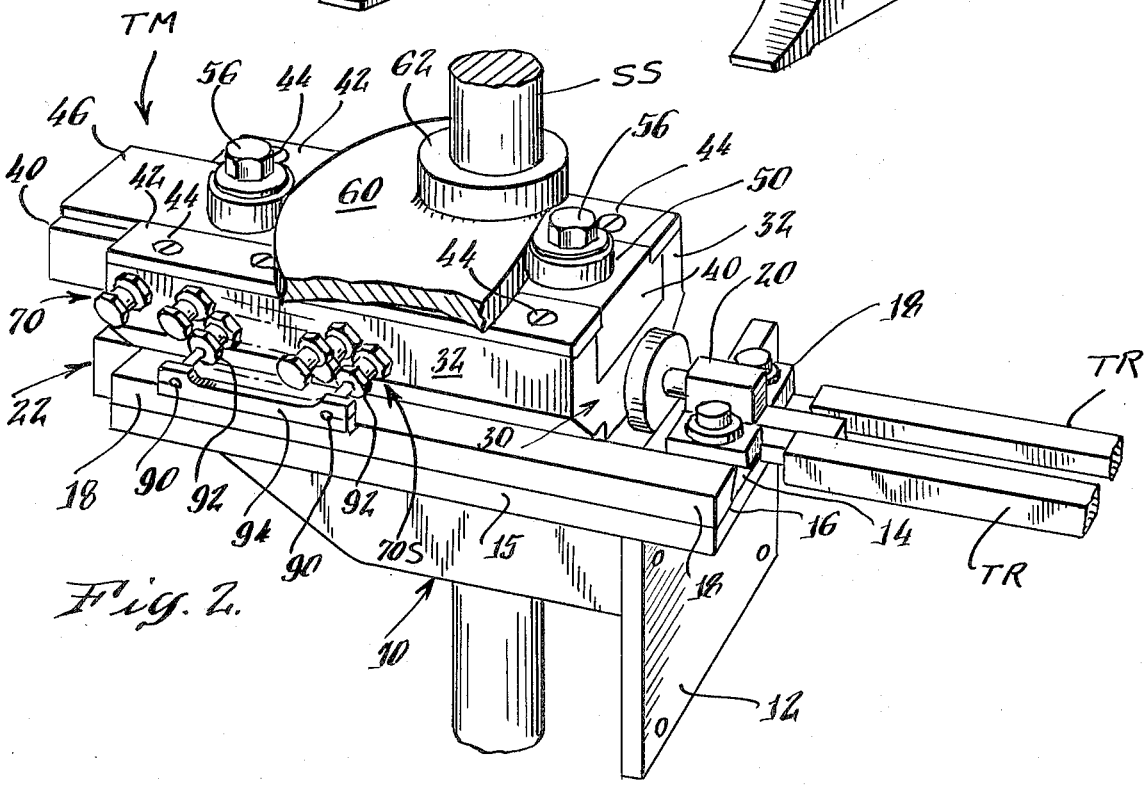
Fig. 2.

SS
60
32
42
40
78
77
100
94
90
44
74
80
82
91
92
70S
76
72
33S
41
30
48
31
33
18
16
10
15
14
70

SS'
40'
42'
60'
100'
154
48'
82'
80'
41'
94'
70S'
150
18'
10'
15'
152
16'
72'
77'
70'

MULTI-STATION TRANSFER PRESS HAVING TRANSFER SLIDE SAFETY RELEASE MEANS

BACKGROUND OF THE INVENTION

The invention relates to multi-station strip metal forming presses of the type including a vertically reciprocating ram for mounting and operating the tools. These presses are well suited for the manufacture of metal parts made sequentially in a succession of drawing operations at the stations. In this type of machine, coil strip stock is fed in widths from a fraction of an inch through up to seven inches on the larger machines. Blanks are automatically cut from the strip, and vertical blank transfer mechanism positively holds and carries the blank down to the transfer level, where it is picked up by the transfer fingers of a horizontal transfer mechanism. Usually the blank is transferred through a succession of draw dies in as many as fifteen individual work stations and, finally, ejected as a completed part. This type of completely automatic operation allows piercing, forming, drawing, lettering, embossing and flanging, as well as side slotting, side piercing and reverse drawing at production rates which have exceeded 250 parts per minute. From blanking operation to finished part ejection, all tooling is mounted in standardized precision die sets to facilitate set up and minimized down time. Each station may be individually adjusted or serviced. Complete die sets can be interchanged without losing tool adjustment. Frequent complete change of jobs or intricate toolings will justify extra die sets.

An example of an early press of this type developed by the assignee of the instant application which sets forth the essential nature of this type of press is found in U.S. Pat. No. 2,049,915 dated Aug. 4, 1936, in the name of Arthur J. Lewis and assigned to the assignee of the instant application. Of course, a large number of improvements have been made since the issuance of the Lewis patent; primarily with a view toward producing higher speeds, lower ultimate tooling costs, precision operation, tool adjustment and replacement, minimizing down time, minimizing scrap loss and, in general, providing greater versatility and operational sophistication for the presses.

The type of press to which my invention pertains is subject to having jams occur, as by work pieces breaking or being improperly positioned at or between work stations during operation, with the attendant risk of seriously damaging expensive components of the press. Some attempts to avoid or minimize such damage have been made by those skilled in the art, as by incorporation of slip clutches in the drive means for the transfer mechanism; however, with only modest success, because slip clutches inherently do not provide "linear" protection throughout the full cycle of operation of the transfer mechanism drive means, i.e., they do not respond to a fixed uniform overload, but rather varying overloads depending upon the cam angle at the time of overload, because the usual drive means is inherently nonlinear.

It is the purpose of my invention to provide an improved transfer mechanism for a multi-station transfer press having a safety release means incorporated in it which reliably provides linear protection; i.e., against jams occurring at any point in the cycle of operation or at any position in the press in response to a fixed, uniform level of overload.

Presses of the type to which my invention pertains usually are provided either without overload protection or with a conventional slip clutch on a drive shaft for the transfer mechanism. Usually the transfer slide is reciprocated horizontally by a cam mounted on a vertical side shaft. The action or motion of the transfer slide is at right angle to the axis of the side shaft. The transfer slide is driven by a conjugate cam mounted on the side shaft which runs against two cam rollers mounted at the top surface of the transfer slide. With each cam revolution, the transfer slide moves to the right, dwells, then moves to the left and dwells again.

Conventionally with the standard unprotected system, when something occurs in the machine or tooling, which accidentally stops the usual transfer rails associated with the transfer slide from moving, then the much more substantial transfer slide driven by the powerful cam continues to try to move the transfer rails. The torque and strength of the side shaft is very great and the cam and transfer slide are very strong. Therefore, when the transfer rails are jammed and stop, something has to give or break. Frequently, it is an expensive press component.

Conventional slip clutch, overload release action, when a slip clutch is provided, results in overload release forces completely dependent on the particular location of the transfer slide when the jam occurs. The conventionally used constant torque release slip clutch is usually mounted on the side shaft and it drives a cam that causes exceptionally high transfer slide forces at the beginning and end of the drive motion and very low forces during the rapid motion of the cam near the middle of the transfer slide stroke. Conventionally, a slip clutch is attached to the drive cam and expected to disengage and release the drive connection when the transfer slide jams, but the force on the transfer slide and cam required to cause disengagement at the beginning and end of motion are much too great with that type of release protection to make the clutch release at a sufficiently lower overload force. This exceptionally high transfer slide load at the start and end of motion, where the cam angle is high, contrasts with too small an overload force in the center of motion required to pop out the conventional release slip clutch, and results in clutch release at too low an overload force causing nuisance releases.

There is a need for my invention, because there is no way of knowing at what position in the press a jam will occur or at what point the transfer slide will be stopped by a jam during its motion. It is imperative that the protective safety release means inactivate the drive at some previously selected uniform overload, and that the release take place at that amount of overload regardless of the location of the jam or operational point during the slide motion. This desirable action is referred to as "linear" protection; a slip clutch does not provide it.

SUMMARY OF THE INVENTION

My invention may be incorporated in newly constructed pressed or retro-fitted to existing presses at minimum modification and cost. Regadless of whether the press is new or retro-fitted, my invention functionally operates to mechanically stop motion of the transfer rails of the transfer mechanism and electrically de-energize the power supply to the press on the occurrence of a predetermined fixed overload caused by a jam occurring anywhere in the press or at any point in its cycle. This operation is achieved by interposing in the usual side shaft cam mounted reciprocating drive system for the transfer mechanism, a pair of blocks that normally are reciprocated jointly to transmit drive force from the side shaft, through the cam and cam rollers, through the transfer slide and to the transfer rails. One block is rigidly secured to the transfer slide and the other block carries the usual cam rollers, and the blocks are operatively connected normally to transmit force through a plurality of spring pressed diplaceable round end pins mounted in one block that have their ends seated in detent inserts mounted in the other block. The operative connection is such that the pin ends are seated with a predetermined amount of spring force so as to aggregate to a predetermined level of force to maintain a drive connection but on the occurrence of an overload force in excess to cause separation of the blocks in the direction of transfer slide movement. On the occurrence of the predetermined overload in the press, caused by a jam, the transfer rails are forcibly stopped with the one block by the jam, but the cam continues to reciprocably drive the other block, causing longitudinal separating shear forces between the blocks that separate them longitudinally by laterally displacing the pins out of the detent inserts to thereby disconnect the driving connection. This action permits the transfer rails and transfer slide to stop, while the cam drive continues to operate and separate the blocks. Therefore, while the one block attached to the transfer slide stops, the other block carrying the cam rollers continues to move, thereby precluding damage. Concurrently with such action, a novel switch means is actuated to de-energize the electrical power supply, thereby stopping the operation of the machine and avoiding damage to any of the parts.

OBJECTS OF THE INVENTION

It is an object of this invention to provide an overload release mechanism for high capacity machine applications that operates in a linear protective fashion, i.e., reacts to a fixed overload force, is compact, and is low cost.

It is another object of this invention to provide a safety release means for the transfer mechanism of a multi-station transfer press that protects linearly over the full cycle of operation regardless of the point in the cycle of operation at which a jam occurs.

It is a further object of this invention to provide such a safety release means which lends itself to either incorporation in newly manufactured transfer presses or to be retro-fitted in existing transfer presses at minimum modification and cost.

Other and more particular objects of the invention will in part be obvious and will in part appear from a perusal of the following description of the preferred embodiment of the invention and the claims taken together with the drawings.

DRAWINGS

FIG. 1 is a front perspective view of a multi-station, strip metal forming, transfer press which incorporates my invention.

FIG. 2 is a fragmentary enlarged perspective view of my improved transfer mechanism incorporating and showing the safety release mechanism of my invention.

DESCRIPTION OF PREFERRED EMBODIMENT

Figure 3:
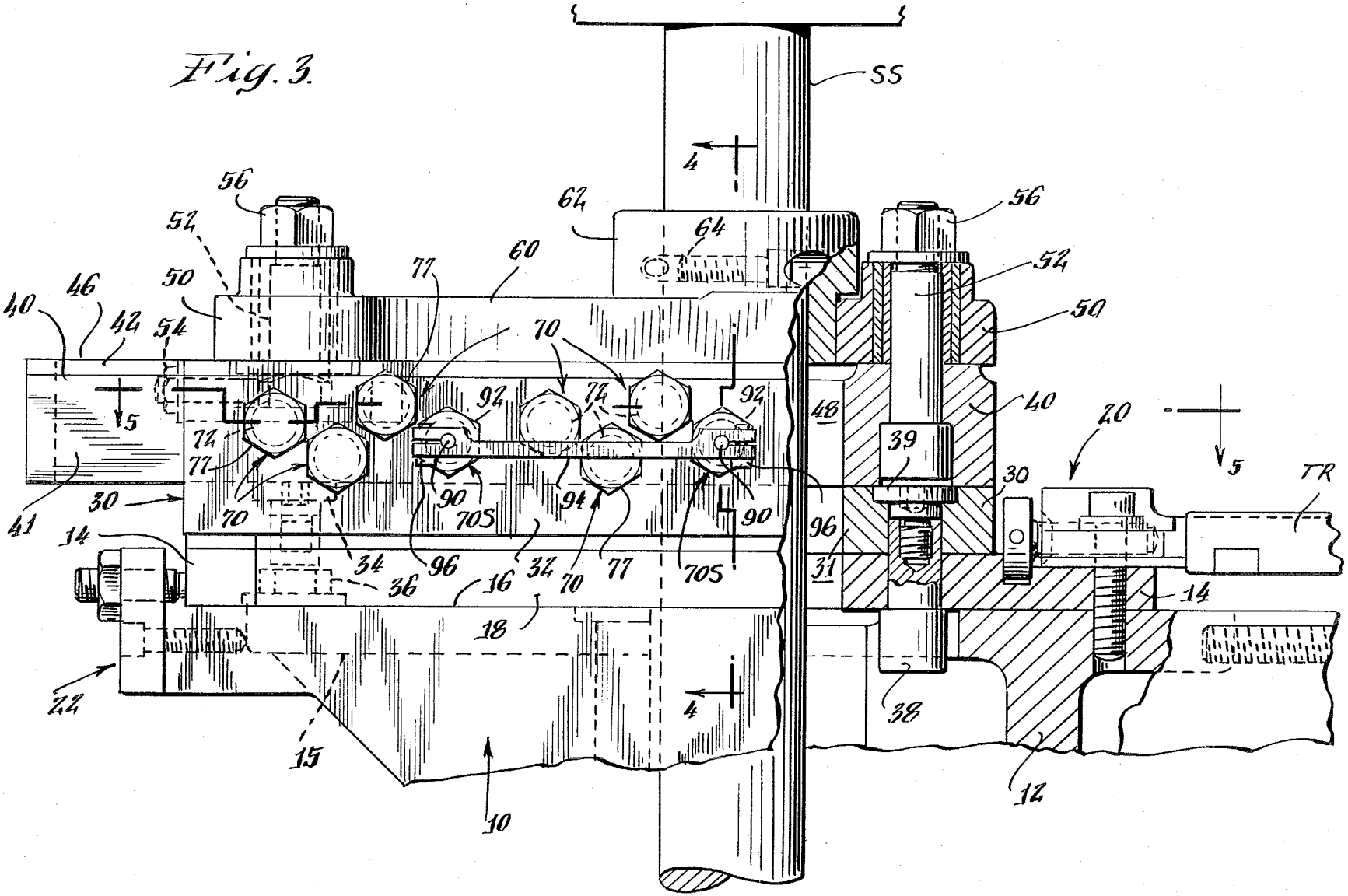
FIG. 3 is a further enlarged side elevational view, having portions cut away to show some of the parts in section, of my invention incorporated in an existing press by retro-fitting.

FIG. 1 illustrates in perspective the top, front and one side of a transfer press which has my invention incorporated in it. It should be clearly understood that other than for the detailed description of the construction and operation of my improved transfer means, the remainder of the transfer press which is illustrated and which will be described herein, is for illustrative purposes only. The principal purpose of my invention is to provide an improved transfer means having a safety release mechanism for a transfer press of the type disclosed and claimed in the referred-to Lewis patent and manufactured by my assignee as Multiple Transfer® presses.

The transfer press TP comprises a frame F which includes at its top a generally horizontally extending crown C supported by a pair of rugged side walls W which extend vertically and at their lower ends are formed with mounting feet MF. Spaced upwardly from the feet of the press is a solid press bed B that extends horizontally between and is supported by the walls W. Mounted for predetermined controlled vertical reciprocation below the crown C and between walls W is the ram R. The ram is mounted in appropriately provided guideways for controlled vertical reciprocation and is operatively associated with the press bed B to effect work on work pieces. A die set of the self-contained interchangeable type is mounted in the press with its die block portion DB being rigidly secured to the bed B and its punch block PB being secured to the ram R. As is well known in the art, the die bed DB is stationary and the punch block PB vertically reciprocates with the ram R relative to the die block. Dies are mounted in positions to be operatively associated with punch tools that are mounted in fixed position on the punch block PB and which, therefore, vertically reciprocate with the ram and punch block relative to the die block and dies mounted therein. The ram is vertically reciprocated by known ram cam and rollers mechanism that is mounted within the housings RC. The ram cams are mounted on a cam shaft MS. The drive for the cam shaft MS comprises a bull gear which is mounted within the housing BG, a fly wheel FW and a motor M which is the main source of power for operating the press. The power drive includes an air clutch-brake mounted within the guard CG, of known construction. The press includes a vertically extending side shaft SS for driving various subassemblies, such as the metal strip feed and the work piece transfer mechanism, which at its upper end through a bevel gear arrangement is driven by the cam shaft MS. Near its lower end the side shaft SS drives a horizontally reciprocable transfer mechanism, of my improved construction, which is disposed within the housing TM. The construction and operation of the side shaft, its beveled drive connection with the cam shaft and its driving connection with the transfer mechanism are all known; however, the transfer mechanism is novel and improved in that it incorporates my safety release mechanism. The press includes appropriate metal strip feed mechanism (not shown), an assembly of lower knockout mechanism K and may include additional features, such as an upper knockout attachment, punch strippers and other attachments or accessories, all known in the art. The press is controlled by an appropriate array of pushbuttons on a panel APB. Other parts shown in FIG. 1 may conventionally appear in known transfer presses, however, they form no part of my invention and therefore will not be described. None of the foregoing press construction, other than for my improved transfer mechanism, constitutes any specific part of my invention; however, it is the type of press environment in which my invention is incorporated.

Figure 7:
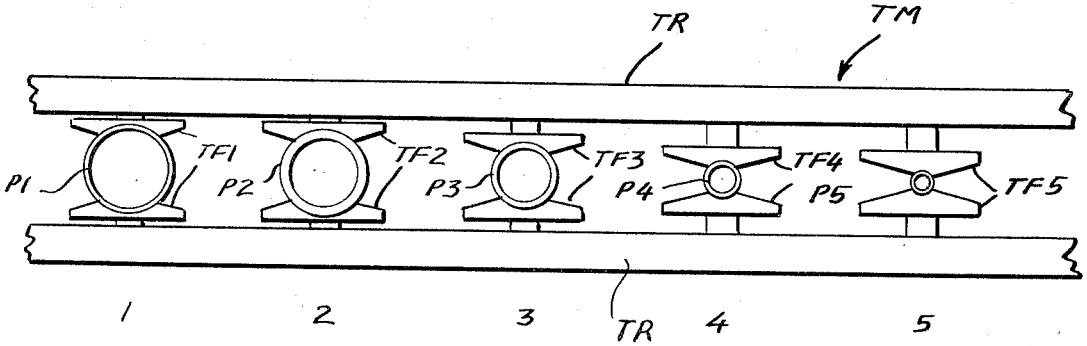
FIG. 7 is a fragmentary plan view of the transfer mechanism showing the transfer rails and fingers gripping work pieces at illustrated word stations 1–5 of the press.
Figure 8:
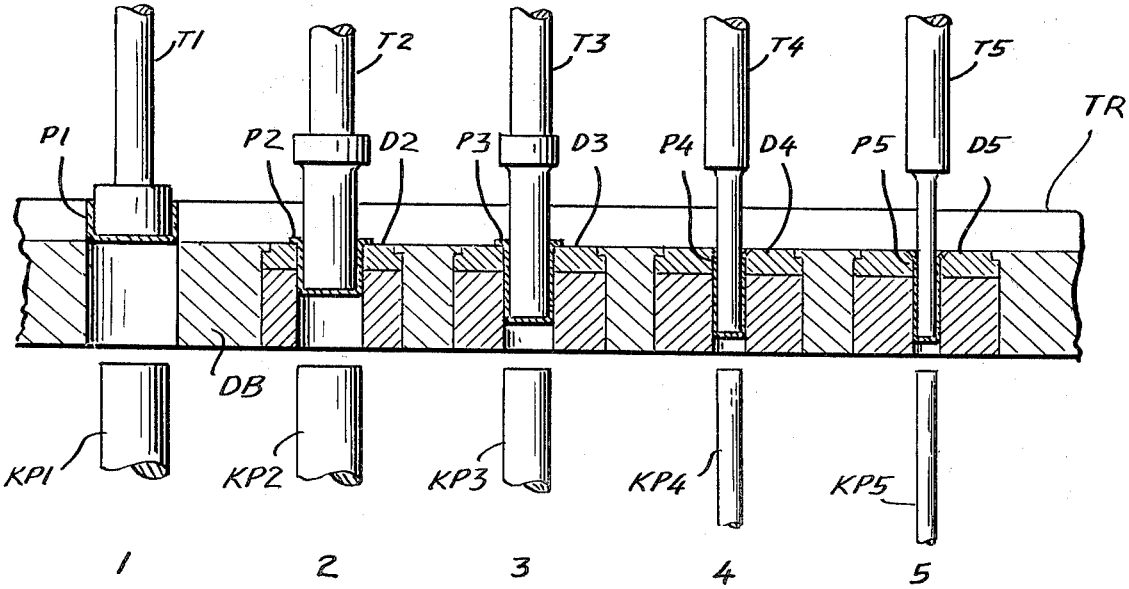
FIG. 8 is a fragmentary vertical sectional view through the punch and die means of the press when operatively positioned to perform work on work pieces at work stations 1–5 corresponding to FIG. 7.

It is understood by those skilled in the art, that a blank, and the part P thereafter formed out of the blank (see FIGS. 7 and 8) sequentially is indexed, i.e., transferred one station at a time in a predetermined controlled timed manner; that when in full operation, the press has a work piece at each station which constitutes a part that has been formed up to the point of forming to that station, and that additional work is performed on the part at each station. The transfer of the work piece is effected by a transfer mechanism of known construction and operation in the art, which is partially illustrated in FIG. 7. It comprises a pair of spaced transfer rails TR that extend horizontally, and support on their opposing sides inwardly biased spring pressed transfer fingers TF. The arrangement is such that the transfer rails and an associated transfer slide jointly reciprocate horizontally in timed relation with the vertical operation of the tools T and knockout plungers KP to the functional end result of transferring a work piece one station at a time, i.e., moving a work station for having work performed thereat, and after the work has been performed, moving the work piece to the next station until the part is finished. In FIG. 7 and FIG. 8, the same part is shown at stations 1, 2, 3, 4 and 5 as it progresses through the press. The same numerical suffix designations for the stations at which the part and components are located are provided in FIGS. 7 and 8. In FIG. 8 a part P is shown as it is formed at a given station, and in FIG. 7, the transfer mechanism at the same station is shown gripping the part in such form and poised to transfer to it the next station.

In order to provide for the positive vertical upward movement of a part out of the die up to the level of the transfer rails after it has been worked upon at any given station, a lower knockout arrangement conventionally is provided. As generally can be seen in FIG. 1, the knockout mechanism assembly K includes a plurality of knockout arrangements, one for each station. During drawing, the part is driven into the die (see FIG. 8) by the punch. Thereafter, the punch, in normal operation, will retract upwardly as the ram moves upwardly, and the part should be delivered by the normal spring bias of the knockout arrangement vertically upwardly to the level of and between the transfer fingers, in order that it may be thereafter transferred to the next station. To insure the vertical upward movement of the part, the knockout mechanism of generally known construction is provided to effect positive movement. The construction and operation of the knockout mechanism is generally known and does not form any specific part of my invention. However, those skilled in the art will understand that it functions, as described, to provide for a positive upward movement of the part after it has been worked upon at any given station to prevent its being inadvertently jammed in locked position in the die after work has been done on the part when it must be moved upwardly to the level of and be gripped by transfer fingers of the transfer mechanism to move the part to the next station.

The normal operation of a transfer press of the type involved as it pertains to tools that are fixed relative to the ram, such as tools T1, T2, T3, T4 and T5, is known, but will be briefly described. The ram is caused to reciprocate vertically in predetermined timed relationship by the ram cam and roller arrangement RC driven by the main shaft MS which, in turn, is driven by the motor M through the clutch mechanism CG. The fixed tools move vertically jointly with the ram R and punch block PB relative to the die block DB an amount limited by the configuration and size of the press. Periodically the fixed tools are downwardly moved into associated dies, D1, D2, D3, D4 and D5 mounted in the die block DB at the respective stations 1, 2, 3, 4 and 5. The blank which has been blanked out of the strip fed to the first station of the press is worked and sequentially indexed by the transfer mechanism to each succeeding station, where additional work is performed on the part.

My improved linearly protective overload release mechanism will now be described in detail with particular reference to FIGS. 2–6, which illustrate an existing press, into which my invention has been incorporated, by retro-fitting, designated the "retro-fitted embodiment." FIG. 9 illustates a newly manufactured machine into which my invention has been incorporated which is designated the "original equipment embodiment" and will be described subsequently. However, aside from some details of construction, the functioning of the two embodiments is similar.

With reference to FIGS. 2–6, the illustrated old portions of an existing press essentially comprise the support bracket 10 rigidly secured to the left hand side wall W, as by a bolted mounting plate 12, and transfer slide 14, which is horizontally slideable supported on the bracket 10 in a dove-tail slideway formed by the top 16 of horizontal wall 15 of the bracket and a pair of spaced gibs 18 secured to the bracket. Slide 14 is adjustably connected to transfer rails TR (at their left hand ends in FIGS. 2 and 3) by a standard adjustable connection block 20 of known construction. An adjustable stop 22 of known construction is carried by bracket 10 at its left hand end in FIGS. 2 and 3 to limit the extreme leftward movement of slide 14 and another stop to be described limits the rightward movement of the slide.

In a standard press, the transfer slide 14 would carry on its top a pair of adjustably spaced cam rollers mounted on vertical axes, between which is mounted a split conjugate driving cam mounted on a vertical axis on a power driven side shaft SS. The rotation of the side shaft rotation the cam which acts on the cam roller to translate the rotary motion of the side shaft into horizontal reciprocation of the slide 14. As is known, with each rotation of the side shaft SS, slide 14 moves to the right, dwells, then moves to the left and dwells again. This action is repeated and timed, in a known manner, relative to the vertical reciprocation of the ram R and knockout plungers KP1–KP5. The cam drive for the slide is a "non-linear" power drive means, i.e., it does not drive the slide with constant torque, but the latter varies with the cam angle active at the time in the cam cycle. If in operation of a standard press unprotected by my invention, a jam occurs anywhere in the press which stops the transfer rails TR from moving normally, the relatively massive transfer slide 14 continues to be driven and drives the transfer rails with substantial force by the large torque of the side shaft SS transmitted by the cam. Some part of the press must give way under these circumstances and eventually does, usually causing damage to an expensive internal part of the press or tooling.

To retro-fit such a standard press with my protective safety release mechanism, all that is required is to remove the cam rollers from slide 14; modify the side shaft SS slightly by extending its cam mounting keyway to allow the vertical position of the conjugate cam to be raised; and provide my unique linear, overload release, double-block mechanism, by securing one block to the top of slide 14 and mounting the usual cam rollers on the top of the other block. The double-block mechanism comprises a generally U-shaped spring-pin assembly retaining, transfer slide release block 30, and a cam roller carrying release block 40 which are operationally connected to normally jointly move, but separate on an overload.

Block 30 is elongated, generally U-shaped in cross-section and has a pair of upstanding side walls 32. Block 30 is rigidly secured to slide 14 by a slide stud 34—fastener 36 connection (at the left hand end in FIGS. 2 and 3) and a stop pin 38—fastener 39 connection (at the right hand end). The head of stop pin 38 functions as a right hand end stop for the slide 14 in a known nammer. Block 30 has a rectangular void 31 for permitting relative longitudinal movement of the block 30 relative to the side shaft SS in operation.

Block 40 is elongated and nests in the block 30 between the side walls 32. At opposite lateral sides of the top of block 40, a pair of spaced longitudinal cutouts are formed, in which are positioned portions of straps 42 that are fixed to the tops of side walls 32 as by screws 44 and retain block 40 within block 30. Normally blocks 30 and 40 move jointly, but they are susceptible of limited relative longitudinal movement in the direction of slide motion on the occurrence of an overload as will become apparent. On the top 46 of block 40 are mounted to rotate on vertical axes, a pair of horizontally spaced cam rollers 50. Rollers 50 are mounted on vertical stub shafts 52 carried by block 40, the left hand one (in FIGS. 2, 3 and 5) of which is adjustably mounted to selectively adjust its axis, as by an adjusting screw 54. Lock nuts 56 are secured to stub shafts 52 to retain the cam rollers on block 40. There is a central, generally rectangular clearance void 48 formed in block 40 for permitting relative longitudinal movement of the block relative to side shaft SS in operation.

When assembled, the side shaft extends vertically through voids 31 and 48 of blocks 30 and 40, and carries a split conjugate cam 60 at a vertical height so as to be supported at the top 46 of block 40 disposed between and in operative driving relation with cam rollers 50. Cam 60 is conjugate, split, drivingly connected in a keyway in the side shaft and has a mounting collar 62 having known fastening means 64 to fit it on side shaft SS for joint movement therewith.

After retro-fitting of a standard press with my double-block mechanism, the parts are disposed and related as illustrated in FIGS. 2–6. The retro-fitting utilizes the standard slide 14 and involves relocating the standard cam rollers 50 from the top of the standard slide to the top of block 40, and raising the level of the standard cam 60 to that of the relocated cam rollers by utilization of the extended keyway in the slightly modified side shaft SS.

My double block mechanism operates on the principle of providing a separable driving connection between the block 30 and 40 of predetermined pressure which ordinarily maintains the blocks operatively connecter for joint movement, but which reacts to separating forces in the direction of slide movement in excess of said pressure caused by a jam at any point in the machine which stops the transfer slide and rails to allow longitudinal separation of the blocks, thereby permitting the block 30 to stop with the transfer slide and rails, and the block 40 to be cntinued to be moved by the cam 60—cam rollers 50, until the power to the motor M is shut off by an actuating bar that trips a limit switch to open the power circuit. The principle of the separation system employs a plurality of laterally displaceable round end spring pressed pins that are removably disposed in detent inserts, the pins being carried by blocks 30 and the inserts by block 40. The ends of the pins engage the inserts with sufficient cumulative pressure to establish a preselected relative shear separating force between the blocks required to separate them longitudinally, by forcing the pins laterally out of the inserts to destroy the pin—insert drive connection for the blocks. The number of pins—inserts arrangements, their dimensions and spring forces are empirically determined for any desired preselected overload separation force. To balance the system, the pins—inserts arrangements are arranged in laterally spaced, opposing relationship on opposite lateral sides of the blocks. Ordinarily, the blocks move jointly, when cam driven, and their separation is constrained only by the cumulative spring pressures of the pins against the inserts. On the occurrence of a jam which stops the transfer rails TR and their connected slide 14, the block 30 stops, but the block 40 continues to be cam driven and moves longitudinally relative to block 30 forcing thepins to pop out of the inserts to permit such movement of block 40 while block 30, slide 14 and transfer rails TR have stopped, thereby preventing continued high torque driving of the transfer rails and consequent damage.

Figure 5:
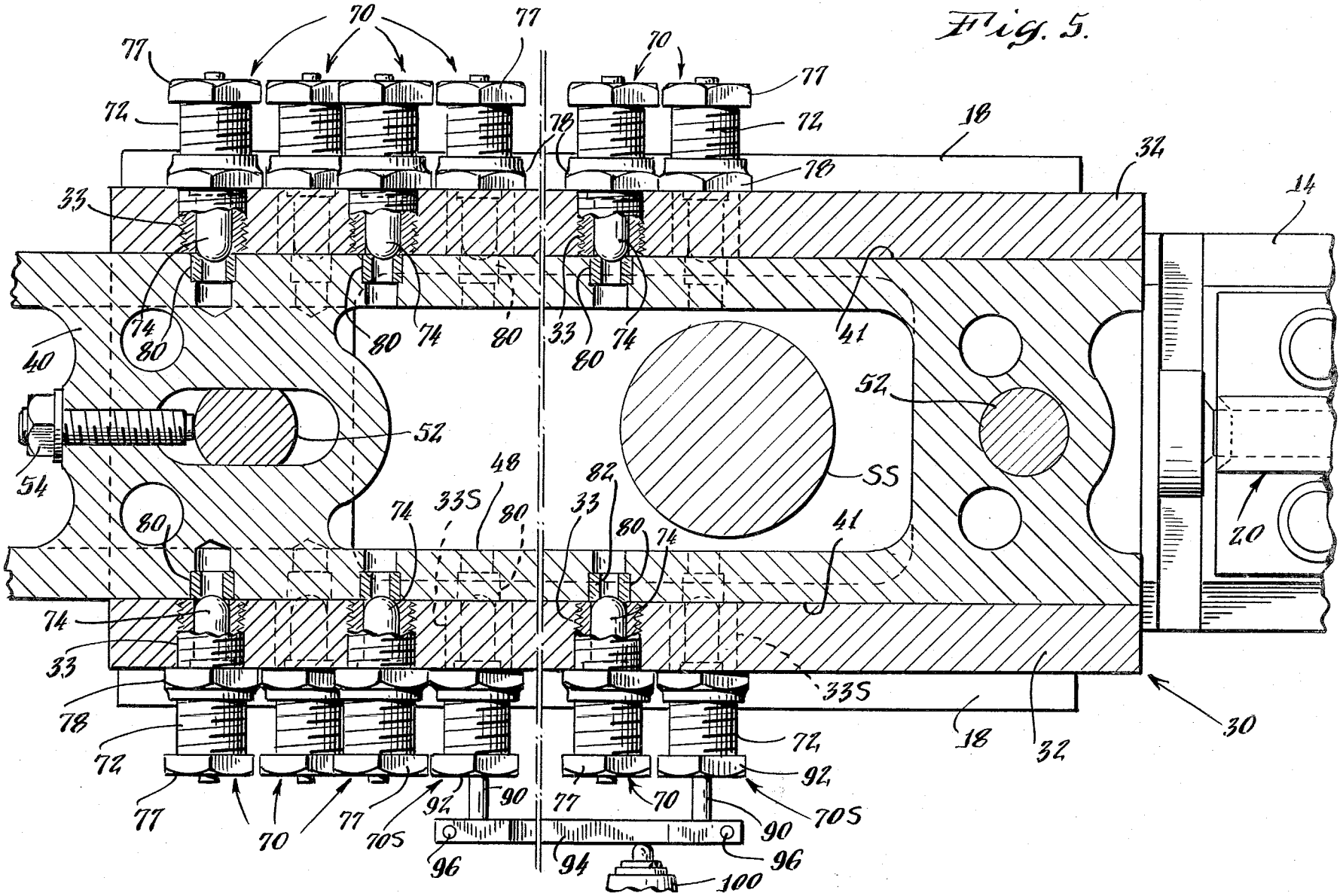
FIG. 5 is a sectional view on a further enlarged scale relative to and taken on line 5—5 of FIG. 3.
Figure 6:
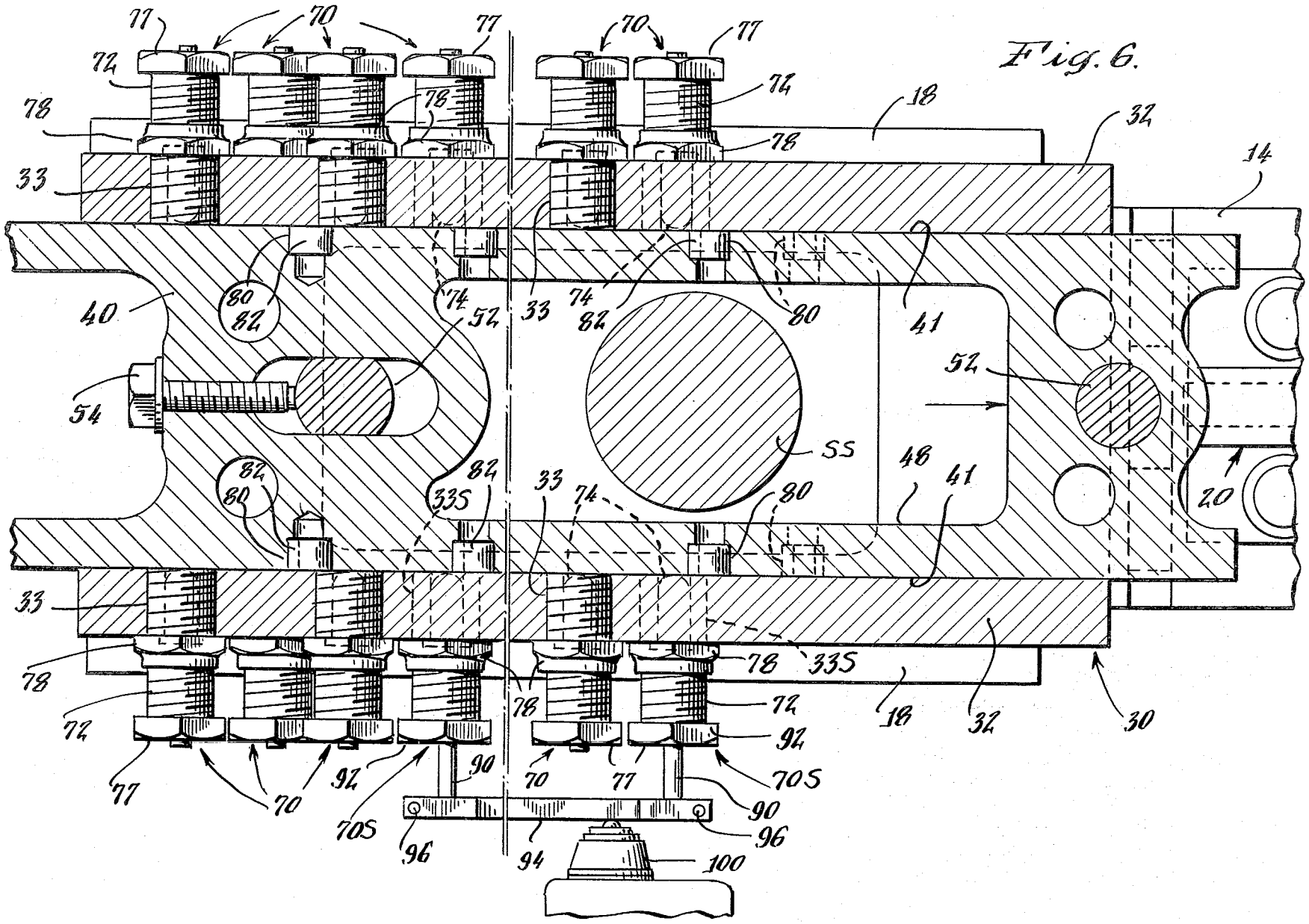
FIG. 6 is a view similar to FIG. 5 but showing the parts of the safety release mechanism in positions after it has been actuated by a jam and the cam drive to the transfer slide has been interrupted.

With the foregoing general understanding of the principle of operation of my safety mechanism, an understanding of the detailed construction and operation will be facilitated. FIG. 5 illustrates the double-block mechanism in normal driving condition, and FIG. 6 is separated condition after an overload.

A plurality of spring plunger assemblies 70 are mounted in each of the side walls 32 of block 30; eight are illustrated, two of which 70S are modified and form part of the de-energizing switch means. Assemblies 70 are known and usually used in jigs and fixtures; each comprises a cylindrical housing 72, all of which are threadedly mounted in staggered tapped bores 33 in side walls 32 (see FIG. 4), each carrying a movable hardened headed pin 74, spring 76, closure 77 and lock nut 78.

In the FIG. 5 condition, the construction and arrangement is such that the pins 74 are spring-pressed and project inwardly through and beyond the openings in side walls 32 of block 30 under preselected pressure against the opposite sides of the block 40.

Disposed on opposite sides of block 40 in bores 80, staggered similarly so as to align with bores 33 and pins 74, and detent inserts 82 of hardened steel.

Figure 4:
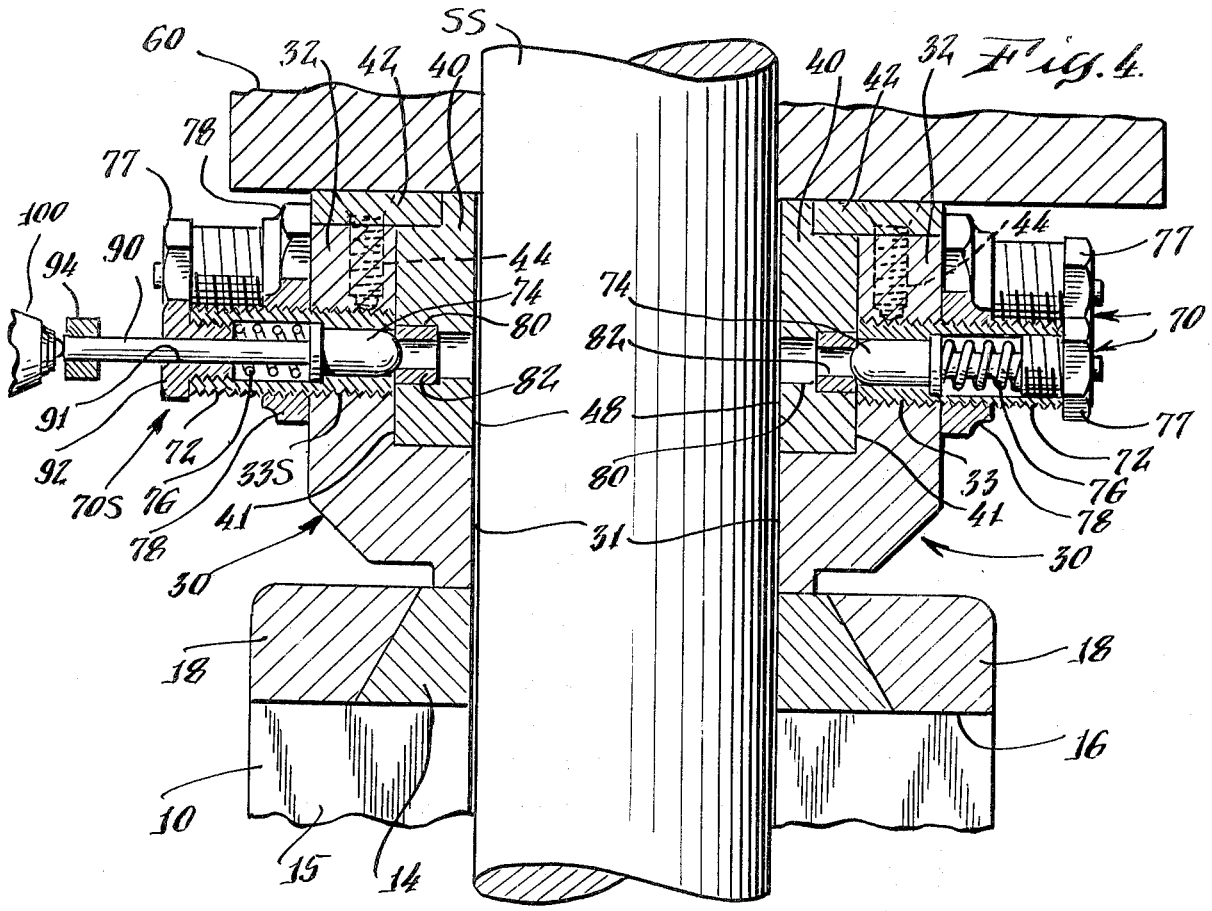
FIG. 4 is a sectional view on a further enlarged scale relative to and taken on line 4—4 of FIG. 3.

When the blocks 30 and 40 are in normal jointly moving position shown in FIGS. 3, 4 and 5, the rounded ends of pins 74 are seated in the slightly smaller diameter openings in detent inserts 82 under predetermined spring pressure and effect a driving, though separable, connection for the blocks. The aggregate spring pressures between all the pins—inserts constitutes the amount of longitudinal shear force between the blocks necessary to force the pins out of the inserts to allow longitudinal separation of the blocks, which corresponds to the level of overload caused by a jam in the press at which separation is desired. The construction and arrangement is such that a jam occurring at any time or anywhere, will uniformly release the blocks to permit separation regardless of the position of the cam and amount of torque being generated at the moment. FIG. 6 illustrates the mechanism after an overload has occurred and the blocks have separated. In this condition, the pins 74 have been forced out of inserts 82 and are urged against the sides 41 of block 40.

The arrangement to de-energize the power source to the main motor on the occurrence of separation will now be described. Two of the spring plunger assemblies, designated 70S mounted in bores 33S, are modified relative to assemblies 70 to provide a limit switch activator for an electrical safety system. The system functions to electrically de-energize the press on an overload, and does not include any moving wires in tripping operation. Assemblies 70S have special elongated pins 90 which extend out of openings 91 in special closures 92 and at their free ends support a limit switch push bar 94, as by pinch bind connections 96 formed at the ends of the bar 94. When separation of the blocks occurs, pins 90 are forced outwardly laterally, with their attached bar 94, to move the bar against a limit switch 100, which is carried on bracket 10, to trip the switch and open the power circuit. Therefore, on an overload, the blocks mechanically separate and the power is electrically shut off stopping the press.

From the foregoing description of FIGS. 2–6, the construction and operation of the retro-fitted embodiment of my invention should be clear to those skilled in the art. On the occurrence of a jam, during operation, caused by any malfunction at any point in the operating cycle and located anywhere in the press, resulting in stoppage of transfer rails TR, the rails and their driving transfer slide 14, along with its connected block 30 stop, but the block 40 continues to move, because of the continuation of the cam drive to its through the cam rollers 50 which it carries. This relative longitudinal movement in the direction of transfer slide motion causes the pins 74, 90 to be forced laterally oppositely outwardly out of their associated detent inserts 82. This action breaks the mechanical drive connection between the blocks, permitting the transfer slide and rails to remain stationary and simultaneously electrically de-energizes the power supply as a result of special pins 90 forcing the limit switch push rod 94 against the limit switch 100 to activate it to open the power circuit. The staggered disposition of the spring plunger assemblies 70, 70S and their dimensional relationship is predetermined so as to require relative longitudinal movement of the blocks 30, 40 in excess of the amount of such movement required to fully mechanically and electrically stop the press before any spring plunger pin 74 will reset in another detent insert 82. See FIG. 3, where it will be noted that only two spaced assemblies are located on the same horizontal line and that there are three intervening staggered assemblies between them. Therefore, before a displaced pin will reset, i.e., project into another detent insert, it will have to be moved longitudinally past three detent inserts. The specific arrangement may be empirically determined and insures against undesired resetting of the pins and reconnection of the blocks in driving relation before the jam is located and rectified.

It will be understood that the transfer mechanism may be adjusted to provide the precise desired stroke movement and characteristic as by changing and/or adjusting the cam 60, cam rollers 50, transfer slide 14, transfer rails TR, all in a known manner.

Figure 9:
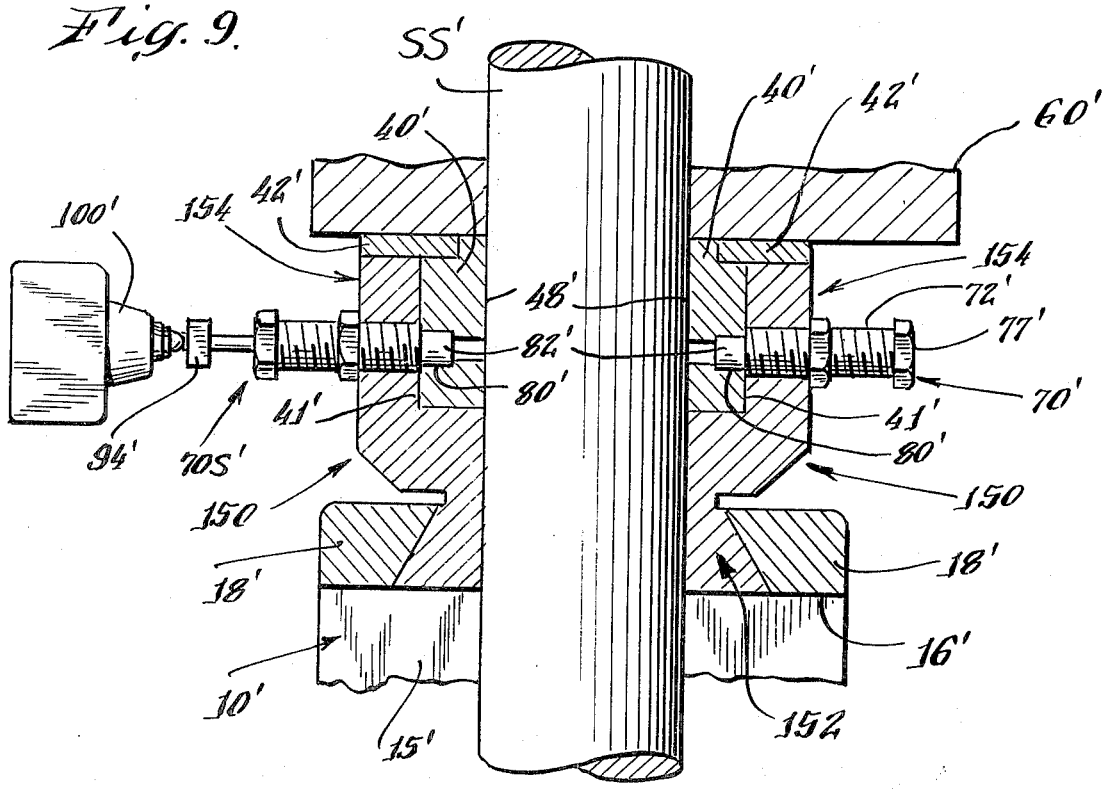
FIG. 9 is a view on a reduced scale relative and similar to FIG. 4 showing my invention incorporated in a newly manufactured press.

The original equipment manufactured embodiment of my invention is illustrated in FIG. 9. It is constructed and operates essentially in the same manner as the FIGS. 2–6 retro-fitted embodiment except that the original separate slide 14 and spring pin retaining assembly block 30 of the retro-fitted embodiment are combined in one structure. The same parts in both embodiments are designated by the same reference characters, but with a prime (') added in the FIG. 9 embodiment. The combination transfer slide—spring pin retaining assembly block in the FIG. 9 embodiment is designated 150, and it comprises transfer slide portion 152 and spring pin retainer block portion 154, both of which are constructed and function similarly to their corresponding transfer slide (14) and block (30) of the FIGS. 2–6 embodiment, but which are integrally formed in the FIG. 9 embodiment.

In view of the foregoing, it should be apparent that I have achieved the objects of this invention. As will be apparent to those skilled in the art, various changes and modifications of the invention can be made without departing from the spirit and scope of the invention, which is limited only by the following claims.

I claim:

1. A multi-station metal forming press comprising: a press frame; means forming a plurality of work stations arranged to support dies; a plurality of punch-like tools operatively disposed relative to said dies; means for operating said tools in a predetermined manner relative to said dies to perform work on workpieces disposed at said stations; means for transferring a plurality of workpieces sequentially in a predetermined manner to each station; power means for driving said transfer means along a horizontal path; and means on the transfer means linearly responsive throughout the horizontal path of its travel to overloads caused by jams occurring anywhere in the press for operationally disconnecting the power means from said transfer means to permit said transfer means to stop to avoid damage to the components of the press while said power means continues to operate.

2. A press as defined in claim 1 wherein said mechanism comprises a plurality of detents in one of said blocks and a plurality of cooperating spring biased pins carried by and projecting from the other of said blocks; the tips of said pins normally being disposed in said detents under preselected spring pressure to maintain the blocks in operationally connected condition to move jointly and maintain the power drive to said transfer slide, but being arranged to be forced out of said detents on the occurrence of an overload allowing said blocks to longitudinally separate, whereby the transfer slide and said one block may stop while the said second block may continue to move, thereby avoiding damage.

3. A press as defined in claim 1 wherein said one block has a pair of spaced, parallel, upstanding walls and said second block is nested within said one block between said walls for longitudinal sliding movement, but normally restrained therefrom; a plurality of detents disposed in opposite side walls of said second block; a plurality of openings in the walls in said one block disposed to be aligned with said detents; and a plurality of spring plunger assemblies mounted in said openings and having spring pressed pins projecting therefrom and disposable in said detents normally to maintain the power drive to said transfer slide.

4. A press as defined in claim 3 wherein said openings are disposed so as to be spaced longitudinally in such manner that no adjacent openings are aligned.

5. A press as defined in claim 3 wherein said openings in said walls are tapped, and said assemblies are self-contained units threadedly secured in said tapped openings and having their pins laterally spring biased inwardly toward said detents, whereby on occurrence of an overload that longitudinally separates said blocks, said pins are popped out of said inserts and forced to move laterally outwardly against their spring bias.

6. A press as defined in claim 5 wherein at least one of said pins has an extension projecting laterally outwardly through its assembly whereby it may function as a switch activator to break the power circuit when an overload causes it to move outwardly.

7. A press as defined in claim 5 wherein two of said pins have projecting extensions which carry a limit switch push bar at their outer ends which is disposable adjacent to a limit switch which is part of the power circuit, whereby on an overload that causes said pins to move outwardly, said two pins move said push rod against said limit switch to activate it to open the power circuit to de-energize the press.

8. A press as defined in claim 1 wherein said transfer slide and said one block are separate elements that are rigidly attached, whereby said transfer slide can be an existing transfer slide to which the said one block is added in retro-fitting an existing press with the invention.

9. A press as defined in claim 1 wherein said transfer slide and said one block are integral.

10. A press as defined in claim 1 wherein said blocks have communicating voids formed in them which extend vertically through them; said power means comprises a vertical side shaft which carries a drive cam operatively associated with cam rollers carried by said second block; and said side shaft extends through said voids.

11. A linearly responsive overload release mechanism comprising a pair of blocks normally operatively connected to transmit longitudinal force by joint movement from a power driving means to a driven means; one of said blocks driving said driven means; the second of said blocks connected to said power means for being directly reciprocated by it with substantial force; a plurality of detents in said second block; and a plurality of cooperating spring biased pins carried by and projecting from said one block, the tips of said pins normally being disposed in said detents under preselected spring pressure to maintain the blocks in operationally connected condition to move jointly and maintain the power drive to said driven means, but being arranged to be forced out of said detents on the occurrence of an overload allowing said blocks to longitudinally separate to interrupt the drive.

12. An overload release mechanism as defined in claim 11 wherein said power means is nonlinear in operation; and said pins are arranged to be forced out of said detents in response to a fixed linear overload.

13. An overload release mechanism as defined in claim 11 wherein said one block has a pair of spaced, parallel, upstanding walls and said other block is nested within said one block between said walls for longitudinal sliding movement, but normally restrained therefrom by the pins-detents arrangement; a plurality of openings in opposite side walls of said second block in which hardened detent inserts are mounted; a plurality of openings in the walls in said one block disposed to be aligned with said inserts, and a plurality of spring plunger assemblies mounted in said openings of the walls of said one block having hardened spring pressed pins projecting therefrom and disposable in said inserts normally to maintain the power drive to said driven means.

14. An overload release mechanism as defined in claim 13 wherein all of said openings aligned in both of said blocks are disposed so as to be spaced longitudinally at different heights so no adjacent openings are horizontally aligned on the same axis.

15. An overload release mechanism as defined in claim 13 wherein said openings in said walls are tapped, and said assemblies are self-contained units threadedly secured to said tapped openings and having their pins laterally spring biased inwardly toward said detents, whereby on occurrence of an overload that longitudinally separates said blocks, said pins are popped out of said inserts and forced to move laterally outwardly against their spring bias.

16. A press as defined in claim 1 wherein two of said pins have projecting extensions which carry a limit switch push bar at their outer ends which is disposable adjacent to a limit switch which is part of the power circuit, whereby on an overload that causes said pins to move outwardly, said two pins move said push rod against said limit switch to activate it.

17. A multi-station metal forming press comprising: a press frame; means forming a plurality of work stations arranged to support dies; a plurality of punch-like tools operatively disposed relative to said dies; means for operating said tools in a predetermined manner relative to said dies to perform work on workpieces disposed at said stations; means for transferring a plurality of workpieces sequentially in a predetermined manner to each station; power means for driving said transfer means; and means linearly responsive to overloads caused by jams occurring anywhere in the press of operationally disconnecting the power means from said transfer means to permit said transfer means to stop to avoid damage to the components of the press while said power means continues to operate; wherein said transfer means comprises a transfer slide mounted for reciprocable movement; said linearly responsive means comprises a separable double-block mechanism; said power means drives said transfer slide through said double-block mechanism; and said double-block mechanism comprises one block which is connected to said transfer slide for joint movement therewith, a second block which is driven by said power means, and linear responsive overload separable means connecting said blocks which responds to a predetermined fixed overload on said transfer slide to permit longitudinal separation of said blocks and disconnection of said power means from said transfer slide regardless of the point in the cycle of press operation at which the overload occurs.

18. A multi-station metal forming press comprising: a press frame; means forming a plurality of work stations arranged to support dies; a plurality of punch-like tools operatively disposed relative to said dies; means for operating said tools in a predetermined manner relative to said dies to perform work on workpieces disposed at said stations; means for transferring a plurality of workpieces sequentially in a predetermined manner to each station; power means for driving said transfer means; and means linearly responsive to overloads caused by jams occurring anywhere in the press for operationally disconnecting the power means from said transfer means to permit said transfer means to stop to avoid damage to the components of the press while said power means continues to operate; wherein said transfer means comprises a transfer slide mounted for horizontal reciprocable movement; said linearly responsive means comprises a double block mechanism, one block of which is connected to said transfer slide and the second block of which is driven by said power means, and linearly responsive overload separable means connecting said blocks; said one block having a pair of spaced, parallel, upstanding walls; said second block being nested within said one block between said walls for longitudinal sliding movement, but normally restrained therefrom; a plurality of detents disposed in opposite side walls of said second block; a plurality of openings in the walls in said one block disposed to be aligned with said detents; a plurality of spring plunger assemblies mounted in said openings and having spring pressed pins projecting therefrom and disposable in said detents normally to maintain the power drive to said transfer slide; said openings being disposed so as to be spaced longitudinally in such manner that no adjacent openings are aligned; said blocks having communicating voids formed in them which extend vertically through them; and said power means comprises a vertical side shaft which carries a drive cam operatively associated with cam rollers carried by said second block; and said side shaft extends through said voids.

* * * * *